US009440331B2

(12) United States Patent
Sawada et al.

(10) Patent No.: US 9,440,331 B2
(45) Date of Patent: Sep. 13, 2016

(54) POLISHING SHEET AND POLISHING TOOL

(71) Applicants: Kiyotaka Sawada, Kanagawa (JP); Jun Zhang, Kanagawa (JP)

(72) Inventors: Kiyotaka Sawada, Kanagawa (JP); Jun Zhang, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/568,477

(22) Filed: Dec. 12, 2014

(65) Prior Publication Data

US 2015/0165592 A1 Jun. 18, 2015

(30) Foreign Application Priority Data

Dec. 16, 2013 (JP) ..... 2013-259152

(51) Int. Cl.
*B24D 11/00* (2006.01)

(52) U.S. Cl.
CPC ..... *B24D 11/00* (2013.01)

(58) Field of Classification Search
CPC ... B24D 11/00; B24D 11/008; B24D 11/005; B24D 11/02
USPC ..... 451/527–539
See application file for complete search history.

(56) References Cited

U.S. PATENT DOCUMENTS 5,352,254 A * 10/1994 Celikkaya ..... B24D 3/16 51/295
5,888,119 A * 3/1999 Christianson ..... B24B 13/01 451/36
5,910,471 A * 6/1999 Christianson ..... B24B 13/01 451/529
7,399,516 B2 * 7/2008 Basol ..... B23H 5/08 204/224 M
2003/0150169 A1 * 8/2003 Annen ..... B24D 11/008 51/300
2004/0040216 A1 * 3/2004 Endoh ..... B24B 7/228 51/307
2005/0118939 A1 * 6/2005 Duescher ..... B24D 11/00 451/527
2006/0172663 A1 * 8/2006 Zhang ..... B24B 37/005 451/5
2006/0258276 A1 * 11/2006 Sung ..... B24D 7/06 451/527
2007/0062124 A1 3/2007 Endoh et al.
2007/0066186 A1 * 3/2007 Annen ..... B24D 11/001 451/41
2007/0093181 A1 * 4/2007 Lugg ..... B24D 3/28 451/41
2007/0243798 A1 10/2007 Annen et al.
2008/0318506 A1 * 12/2008 Brown ..... B24D 11/00 451/539

FOREIGN PATENT DOCUMENTS

| | | |
|---|---|---|
| JP | 1-149263 | 10/1989 |
| JP | 2003-105324 | 4/2003 |
| JP | 2004-82323 | 3/2004 |
| JP | 2004-106121 | 4/2004 |
| JP | 2009-534202 | 9/2009 |
| JP | 2011-231135 | 11/2011 |

* cited by examiner

*Primary Examiner* — George Nguyen
(74) *Attorney, Agent, or Firm* — Cooper & Dunham LLP

(57) ABSTRACT

A polishing sheet comprising a plurality of convex portions which protrudes from a sheet surface and includes an upper surface which is in parallel to the sheet surface is disclosed. A plurality of abrasive grains made by a granular porous body in which a number of primary particles are partially bonded to each other and include a void in between is arranged at least on the upper surface of the convex portion.

4 Claims, 4 Drawing Sheets

Prior Art

Prior Art

POLISHING SHEET AND POLISHING TOOL

CROSS-REFERENCE TO RELATED APPLICATION

The present application is based on and claims priority from Japanese Patent Application No. 2013-259152, filed on Dec. 16, 2013, the disclosure of which is hereby incorporated by reference herein in its entirety.

BACKGROUND

Field of the Invention

The present invention relates to a polishing sheet for polishing in which abrasive grains are fixed onto a sheet, and to a polishing tool including said polishing sheet.

Water stains are deposited on a surface of a mirror or glass, a faucet, a bathtub, and a sink installed in a bathroom or washroom, kitchen equipment and so on due to an effect of the environment in which water is used. Among these, in particular, water stains on the mirror or the glass are too hard to remove because the principal component thereof is calcium carbonate or silicon precipitated from water.

Herein, Patent Document 1 (Japanese Patent Publication No. 2011-231135) discloses a polishing (washing) process which performs polishing with use of aerated water. The aerated water is generated through a chemical reaction between sodium hydrogen carbonate (sodium bicarbonate) and citric acid in detergents and water. The polishing (washing) is performed by the behavior of calcium carbonate as one of the main components of water stains that is calcium carbonate dissolved in aerated water.

Such an art in Patent Document 1 has an advantage in which an environmental burden can be reduced remarkably because of an enhancement in the coefficient of use of dietary ingredients. However, when the water stains are thick, particularly, when the stains penetrate into the glass and so on, that is, in a so-called imbricate structure, it is difficult to remove the water stains completely by scrubbing-wash with a sponge and so on, although the water stains are softened to some extent and dissolved.

On the other hand, a piece of commercially available sandpaper is experimentally used for removal of water stains on a surface of a mirror or glass. However, the material of abrasive grains in the sandpaper is selected from alumina, silica, zirconia, and so on, which have a higher hardness than that of the mirror or glass. Therefore, there is a disadvantage in that the polishing sheet that may cause scratching on the surface of the mirror or glass although it is useful in the removal of the water stains.

Patent Document 2 (Japanese Patent Publication No. 2003-105324) discloses a polishing tool for glass, a silicon wafer, and so on. Herein, an example of a sheet according to the art in the Patent Document 2 in which abrasive grains 1 are arranged on one surface of a sheeted base material by a binder layer 2 is illustrated as a model in FIG. 9.

Even if the invention disclosed in Patent Document 2 is applied for removal of water stains on a mirror 5 or a surface of glass, the effect of the invention cannot be achieved sufficiently. Particularly, when it is attempted to remove water stains 6 in an imbricate structure, it is required to apply a great deal of power for polishing (washing). In this case, the polishing efficiency for water stains is significantly low, and furthermore, a problem in which the removed water stains or dropped abrasive grains cause a failure such as scratching on the surface of the mirror or glass occurs.

Patent document 3 (Japanese Patent Publication No. 2004-82323) discloses a polishing tool which includes a block-shape polishing layer 32 which is arranged on a surface of a sheet 30 through a binder layer 31 as shown in the model sectional view in FIG. 10. The block-shape polishing layers 32 are arranged at intervals in between as shown in the model perspective view in FIG. 11.

When the above-described polishing tool is used for the removal of water stains on a surface of a mirror or glass, it is difficult to avoid scratching on the mirror or glass caused by particles of the removed water stains or the dropped abrasive grains from the polishing tool although a polishing efficiency and an operational efficiency are in good condition.

Patent Document 4 (Japanese Patent Publication No. 2004-106121) discloses a manufacturing method of a polishing sheet. In the method, ultrafine polishing-particles are filled with a depressed portion having a specific shape which are arranged on the surface of a metallic mold, and the ultrafine polishing-particles are burned so that the particles are directly and partially bonded each other. Thus, an aggregate body of the polishing particles has a specific shape and inside thereof a void is formed. Then, the aggregate body of the ultrafine polishing particles is transferred onto the surface of the base material sheet through a binder. The polishing sheet is thus manufactured.

When the above polishing sheet is used to remove water stains on a surface of a mirror or glass, the polishing efficiency is low and after all, a problem in which scratching and so on is generated on the surface of the mirror or glass occurs.

SUMMARY

An object of the present invention is to provide a polishing sheet and polishing tool through which the above-described problems in the conventional polishing sheet can be solved, water stains adhered on a surface of a mirror or glass, especially water stains in an imbricate structure which have been extremely difficult to be removed by the conventional polishing sheet or polishing tool can be removed easily with a small force, and a risk of scratching the mirror or glass can be reduced.

In order to solve the above problems, a polishing sheet according to the present invention includes a plurality of convex portions which protrudes from a sheet surface and includes an upper surface which is in parallel to the sheet surface. A plurality of abrasive grains made by a granular porous body in which a number of primary particles are partially bonded to each other and include a void in between is arranged at least on the upper surface of the convex portion.

BRIEF DESCRIPTION OF THE DRAWINGS

The accompanying drawings are included to provide further understanding of the invention, and are incorporated in and constitute a part of this specification. The drawings illustrate Embodiments of the invention and, together with the specification, serve to explain the principle of the invention.

FIG. 1 is a model diagram of an abrasive grain 1 which is used in the present invention. The abrasive grain 1 is comprised of a granular porous body formed by a number of primary particles 1*a* partially bonded to each other and having a void in between.

DETAILED DESCRIPTION OF THE PREFERRED EMBODIMENT

As a result of studying a polishing sheet according to a conventional art, the inventors of the present invention found that scratching on a surface of a mirror or glass may be generated because of the following reasons.

That is, in the art represented in Patent Document 3, large-size water stains or abrasive grains dropped from a binder layer while polishing stay at a portion on the sheet surface on which the binder layer is not provided. The water stains and the dropped abrasive grains contact the surface of the mirror or glass to be polished on the portion and thus scratching and so on may be generated thereon.

The binder layer herein is required to have an appropriate thickness so that the abrasive grains can protrude from the binder so as to keep a necessary range for polishing. If the binder layer is configured to be too thick, the abrasive grains are precipitated in the binder layer and cannot work effectively in the polishing work.

The method represented in Patent Document 4 is such that the abrasive grains are transferred onto the base material sheet under the condition in which the binder is not yet hardened, and the binder is hardened after the abrasive grains are transferred. Therefore, the bonding power between each polishing particle in the aggregate body of the polishing particle and the binder layer decreases, so the abrasive grains are dropped while polishing and cause scratching of the object to be polished. In addition, because the aggregate body of the ultrafine polishing-particle is hard and the flexibility thereof is low, it becomes obvious that the ability of the aggregate body to match a shape of the water stains on the surface of the mirror or glass is low, and the polishing efficiency is also low.

Considering the above-described results of study of the conventional art, the inventors of the present invention reached the configuration of the present invention in which a convex portion which protrudes from a sheet surface includes an upper surface which is in parallel with the sheet surface, and a plurality of abrasive grains is arranged on the upper surface.

Hereinafter, the present invention will be described with reference to the drawings.

Figure 1:
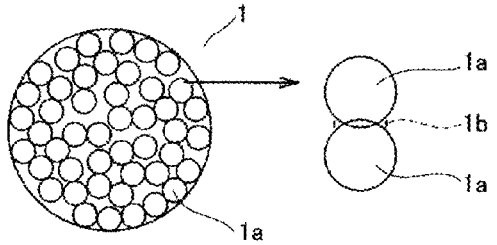

FIG. 1 is a model diagram of an abrasive grain 1 which is employed in the present invention and is configured by a granular porous body in which a number of primary particles are partially bonded to each other so as to have a void.

The abrasive grain 1 is a granular porous body which is composed of an inorganic hard material and is obtained by processing heat treatment on a secondary particle which is formed by a number of aggregated primary particles 1*a* at a temperature such that a neck 1*b* of hyperboloid of one sheet can be formed on the bonding point of each primary particle. Furthermore, a number of primary particles are partially bonded to each other so as to have a void in between. Such a granular porous body can be manufactured, for example, by a method represented in Japanese Patent Document 2, and so on.

As the primary particle, zirconium oxide, cerium oxide (ceria), silica, alumina, or titanium oxide can be used, or a mixture of these is also applicable. Because the hardness of every component as above is at a high degree, the granular porous body which is made of these components becomes an abrasive grain which can obtain high efficiency in polishing and washing.

The secondary particle can be formed with use of these primary particles by the conventional method, such as a sol-gel method or spray-dryer method. The granular porous body is obtained by processing a heat treatment on the secondary particle under the condition that the configuration shown as a model in FIG. 3 can be achieved.

Such an abrasive grain of the granular porous body is gradually abraded away while it is used in the polishing and washing. However, in such a condition, not only the outer surface of the abrasive grain which contacts the object to be polished (washed), but also each primary particle which is inside the abrasive grain also functions as a cutting blade.

From such a configuration, even if one abrasive grain (secondary particle) is used, it can substantially function as if it is a number of abrasive grains (primary particles). Thus, polishing or washing can be performed at a high speed.

In addition, because the primary particles are bonded with each other without a binder in the above-described abrasive grain, clogging between each primary particle or each abrasive grain caused by the binder upon polishing does not occur. Therefore, high-speed polishing or washing can be maintained for a long time.

Particularly, it is appropriate to have a number average particle diameter of the primary particle (median diameter D50) to be made equal to 5 μm or less, because the above-described efficiency becomes high between the range. Additionally, at the same time, scratching and so on, on the surface to be polished can also be prevented effectively when the number average particle diameter of the primary particle is in such an average particle diameter range.

The appropriate number average particle diameter for the abrasive grain which is employed in the present invention is from about equal to 10 μm or more and equal to 300 μm or less, preferably from about equal to 40 μm or more and equal to 100 μm or less. If the number average particle diameter is too small, it is difficult to keep the protruding range of the abrasive grain from the binder, and the operational efficiency is reduced in addition to the fact that the operating life, that is, the term capable of being used in polishing may become shortened. On the other hand, if the number average particle diameter is too large, it may lead to scratching on the object to be polished.

When compression breakdown strength of the abrasive grain is equal to 1 MPa or more and equal to 500 MPa or less, an appropriate wear rate can be obtained while polishing or washing, so both high efficiency in polishing and the effect to prevent the surface to be polished from scratching can be achieved.

Next, a sheet having a surface on which the above-described abrasive grain is arranged will be described.

Generally, a so-called embossed sheet composed of resin and on which a convex portion is formed is employed as a sheet used in the present application (in the present invention, "a film" generally having a thickness equal to 200 μm or less is also called a sheet).

Such a generally used resin can be employed as a material of the sheet, that is, polycarbonate, polyethylene naphthalate, polypropylene, polymethyl metaacrylate, polyethylene terephthalate, and so on, can be used. Among these, polyethylene terephthalate is preferable because it has variations in thickness, mechanical strength, and great flexibility.

Figure 2:
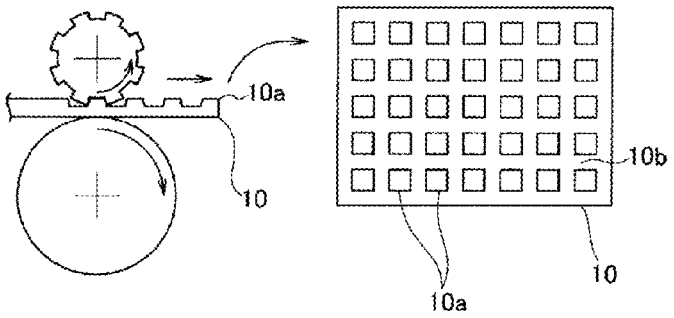
FIG. 2 is a diagram illustrating an example of a sheet (base material) provided with a plurality of convex portions, which is used in the present invention, and a method of manufacturing the sheet.

FIG. 2 shows a model explanatory diagram (left side) illustrating an example of a method to manufacture a sheet in which a convex portion is formed, that is, a so-called embossed sheet, and shows a model upper surface diagram (right side) illustrating an example of a sheet 10 which is manufactured by such a method and includes a plurality of convex portions thereon.

That is, the sheet 10 which has a plane lower surface and an upper surface on which a plurality of convex portions 10*a* is arranged so as to protrude from the sheet surface can be manufactured by passing the resin sheet between a pair of rollers shown in the left side portion of FIG. 2.

Such a pair of rollers includes a concave-convex roller having concave and convex portions on a surface thereof (upper roller) and a plane roller (bottom roller). Upon forming a convex portion, a sheet can pass between the rollers while the sheet and/or at least one of the rollers are heated as necessary.

A height of an upper surface 10*a*1 of a convex portion 10*a* from the sheet surface 10*b* (refer to FIG. 3) depends on a diameter of the abrasive grain to be used. Generally, it is 10 μm or more and 600 μm or less, preferably 40 μm or more and 200 μm.

Herein, it is appropriate to configure the concave-convex rollers to include the convex-concave portion on the surface such that a convex portion to be formed on the sheet has a sectional surface which is perpendicular to the sheet surface to be a trapezoid, and two angles formed by an upper base on the upper surface 10*a*1 side and the two sides of the trapezoid are always an obtuse angle. It is preferable for the range of the obtuse angle herein to be within approximately 100 degrees or more and 135 degrees or less, because high efficiency in the operation can be achieved. It is more preferable for the range to be 110 degrees or more and 120 degrees or less.

It is appropriate to form the convex portion 10*a* so that the upper surface 10*a*1 of the convex portion has a total area to be 20% or more and 80% or less relative to the total area of the sheet (100%), in order to remove the water stains easily with a small force. It is more preferable for the range of the total area of the upper surface 10*a*1 to be 40% or more and 60% or less relative to the total area of the sheet (100%).

Figure 3:
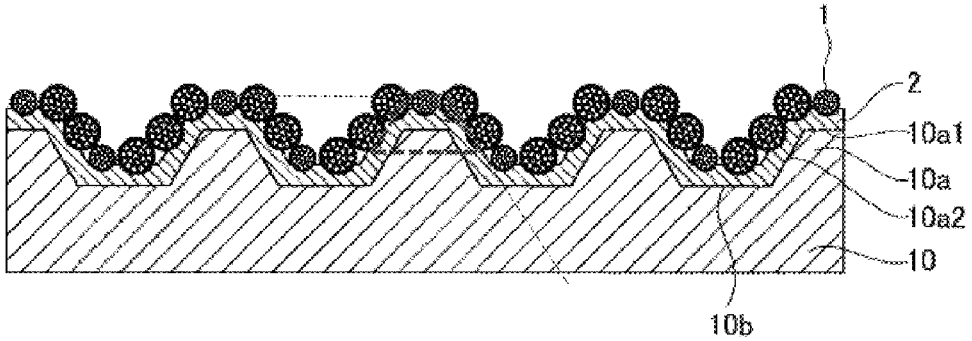
FIG. 3 is a sectional model diagram illustrating an example of a polishing sheet according to the present invention.

Then, a binder is applied on the surface where the convex portion 10*a* of the sheet 10 including a plurality of convex portions is formed so as to configure a binder layer 2 (refer to FIG. 3). The above-described abrasive grain 1 is arranged on the binder layer 2. The abrasive grain 1 is held by the binder layer 2 and arranged so that the upper-side surface thereof protrudes from the binder layer 2. Thereby, the abrasive grain 1 is provided on the upper surface 10*a*1, the side surface 10*a*2 of the convex portion 10*a*, and the sheet surface 10*b*.

In order to form the binder layer, a wire bar coater, die coater, comma coater, gravure coater, knife coater or the like can be used.

It is necessary to configure the binder to have a good adherence property in order to prevent the drop of the abrasive grain or the peel-off of the binder layer itself from the sheet. Such drop or peel-off causes scratching on the object to be polished. In addition, the binder is required to have water resistance when water is used together for polishing (such polishing is called as "washing"), or when the mirror or glass in the bathroom or outside is polished. As s material for such a binder, urethane series, polyester series, or polyolefin series is considered.

Because the abrasive grain should protrude from the binder layer 2, it is necessary for the thickness of the binder layer 2 to be 2 μm or more and 150 μm or less, more preferably, to be 10 μm or more and 50 μm or less, although it depends on the size of the abrasive grain to be used.

FIG. 3 illustrates an example in which the sheet surface 10*b* between each convex portion 10*a* having a rectangular surface on both upper and bottom sides is arranged so as to configure a grid pattern. However, the present invention is not always limited to the above configuration. The convex portions can be arranged in a circle, ellipse, free-curved shape, or the appropriately combined layouts of these may be used.

FIG. 3 illustrates a sectional model diagram of the first example of the polishing sheet of the present invention which is configured as described above. In the present invention, it is necessary to arrange the abrasive grain 1 on the upper surface 10*a*1 of the convex portion 10*a*, and the side surfaces 10*a*2 of the convex portion 10*a* around the upper surface 10*a*1.

When the polishing sheet having a sectional surface as shown in FIG. 3 is used so as to contact with, especially pressure-contact with the object to be polished, and slidably move thereon, the polishing work is operated as follows. That is, according to the above-described configuration, the polishing work starts as follows. The abrasive grain 1 abuts on water stains protruding from the surface of the object to be polished so as to cut away them. Such an abrasive grain 1 is arranged on a so-called shoulder portion which is on a side surface 10*a*2 around the upper surface 10*a*1 of the convex portion 10*a* on an upper stream side of the traveling direction of the convex portion 10*a*. Then, the water stains are polished furthermore by the abrasive grain on the upper surface 10*a*1 of the convex portion 10*a*. Then, the polishing work stops until the abrasive grain on the next convex portion 10*a* contacts the water stains but the polishing sheet comes closer to the object to be polished during this step. Thereafter, the cutout operation starts again on the position closer to the object to be polished relative to the previous contacting point by the abrasive grain arranged on the side surface 10*a*2 around the upper surface 10*a*1 of the next convex portion 10*a*.

As described above, by providing the abrasive grain 1 not only on the upper surface 10*a*1 but also on the side surface 10*a*2 around the upper surface 10*a*1, high polishing efficiency can be achieved. Such efficiency can be enhanced when the convex portion 10*a* formed on the sheet 10 has the sectional surface which is perpendicular to the surface of the sheet and has a trapezoid shape, and two angles formed by an upper base of the trapezoid around the upper surface 10*a*1 and two sides of the trapezoid are always an obtuse angle. This is because the number of abrasive grains 1 on the side surface 10*a*2 which contributes to the polishing is increased.

In the example of the polishing sheet as shown in FIG. 3, the sheet 10 includes one side surface provided with a plurality of convex portions, and the other surface having a plane surface; however, a sheet which includes a concave portion on the other surface corresponding to the surface where the convex portion is formed may be also employed in the present invention.

Figure 4:
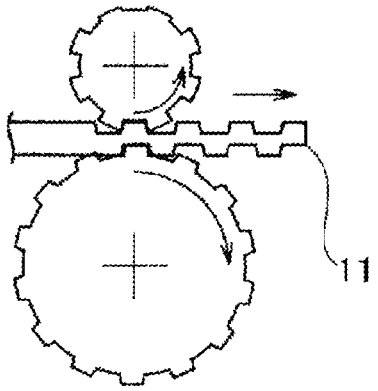
FIG. 4 is a diagram illustrating another example of a method of manufacturing the polishing sheet provided with the convex portion which is used in the present invention.

FIG. 4 illustrates a method of manufacturing such a sheet as a model. A pair of rollers which is employed in this example is a concave-convex roller having concave and convex portions on both surfaces. The rollers are driven and rotated so that when a convex portion on a surface of one roller contacts one surface of a sheet, a concave portion on a surface of the other roller locates on the other surface side of the sheet to be processed. Thus, a sheet 11 including a convex portion on one surface and including a concave portion on the corresponding other surface is obtained.

Figure 5:
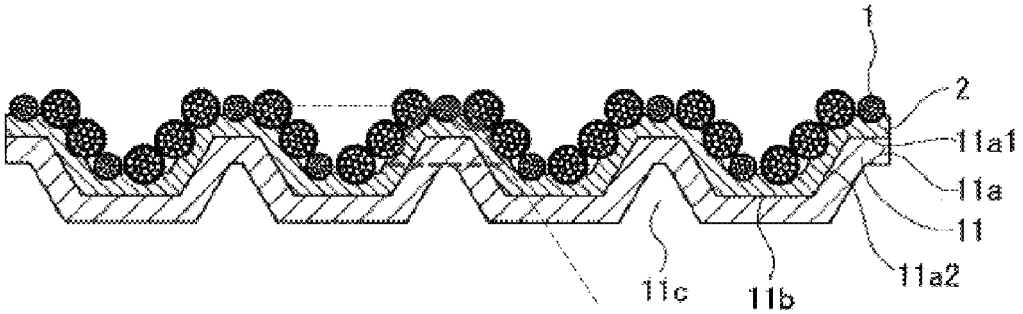
FIG. 5 is a sectional model diagram illustrating another example of the polishing sheet in the present invention.
Figure 6:
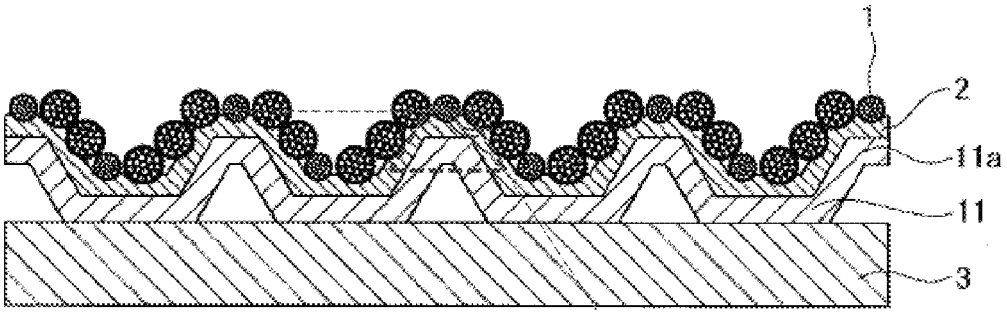
FIG. 6 is a sectional model diagram illustrating an example of a polishing tool formed by applying a liner material 3 on a rear side of the polishing sheet shown in FIG. 5.

FIG. 5 illustrates a sectional model diagram of the example (second example) of the polishing sheet which is manufactured according to the example of the sheet 11 on which a plurality of convex portions 11*a* is provided as described above. The sheet 11 includes a plurality of convex portions 11*a* which is arranged so as to protrude from the sheet surface 11*b*. The convex portion 11*a* includes an upper surface 11*a*1 which is in parallel with the sheet surface 11*b*, and a sectional surface of the convex portion 11*a* is a trapezoid. Both two angles formed by an upper base on the upper surface 11*a*1 side and two sides 11*a*2 of the trapezoid are always an obtuse angle. In addition, a concave portion 11*c* is formed on a rear surface of the sheet which corresponds to the surface having the convex portion 11*a*. The example of the polishing sheet shown in FIG. 5 is similar to the above-described first example except that the sheet 11 is employed instead of the sheet 10.

It is necessary to select the material and thickness of the sheet 11 appropriately so that the convex portion 11*a* does not collapse completely upon contacting the object to be polished when the sheet is used as a polishing sheet.

These examples of the polishing sheets according to the present invention can be directly employed in polishing work. However, for example, when it is used as a polishing tool after bonding a liner material 3 on the back surface where the abrasive grain 1 is not disposed, the operational efficiency and handling capability can be enhanced. In addition, because the liner material 3 is bonded on the sheet 11 in this example, the convex portion 11*a* is hard to collapse during polishing work. As a result, high efficiency in operation can be easily maintained even if a relatively thin base-material sheet is employed herein.

A material having flexibility is appropriate for the liner material 3 so as not to decrease contact ability with the object to be polished. For example, a rubber sheet, rubber plate, various types of sheets, or clothes (woven fabric/non-woven fabric) or the like may be appropriate.

In the above-described examples 1 and 2, the abrasive grain is provided on an area other than the area where the abrasive grain is necessarily arranged, which is on the upper surface of the convex portion and the side surfaces of the convex portion around the upper surface side. In other words, the abrasive grain is arranged on an area which does not need the abrasive grain such as the portion having a groove-like form in between each convex portion on the sheet surface. Essentially, the abrasive grain provided on that portion does not often contribute to the polishing. In this instance, more than the necessary amount of the abrasive grain than originally required is provided.

Next, an example (third example) of the polishing sheet without having the abrasive grain on the groove-like portion will be described.

Figure 7:
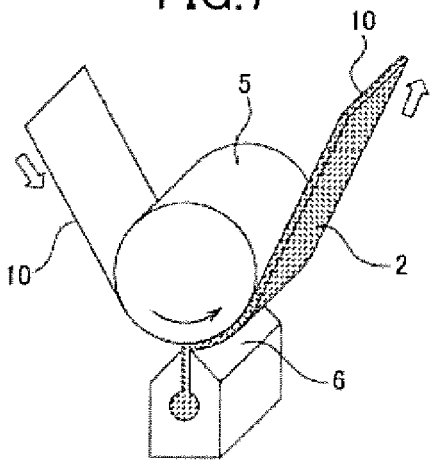
FIG. 7 is a model diagram illustrating a method of manufacturing a polishing sheet of another example of the present invention.
Figure 8:
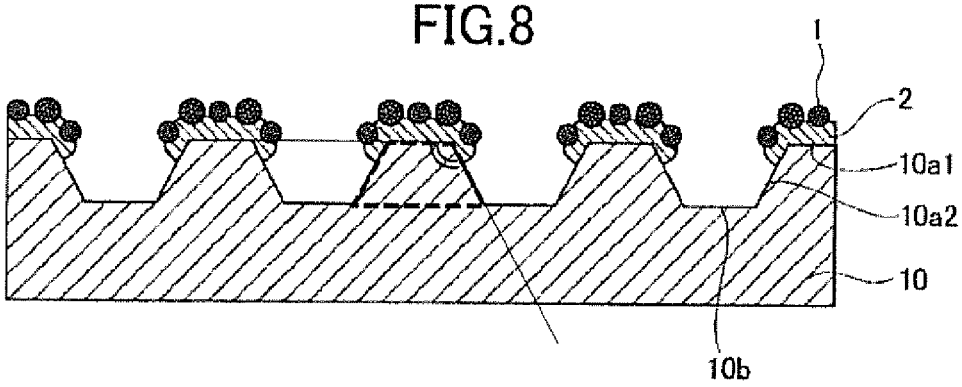
FIG. 8 is a sectional model diagram illustrating an example of the polishing sheet according to the present invention which is manufactured by the method shown in FIG. 7.
Figure 9:
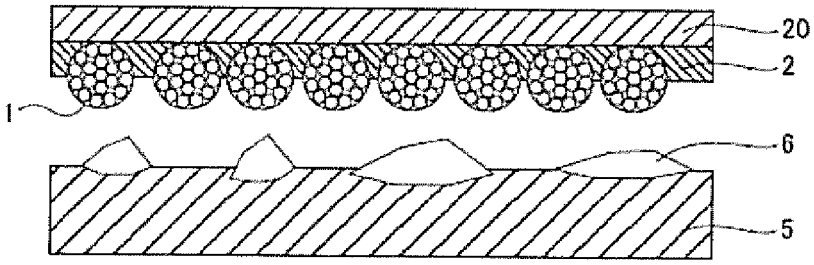
FIG. 9 is a sectional model diagram illustrating an example of a conventional polishing sheet and a mirror of an object to be polished on which water stains are adhered.
Figure 10:
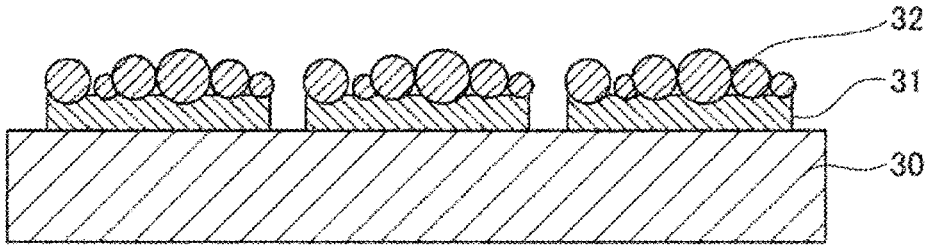
FIG. 10 is a sectional model diagram illustrating an example of another conventional polishing sheet.
Figure 11:
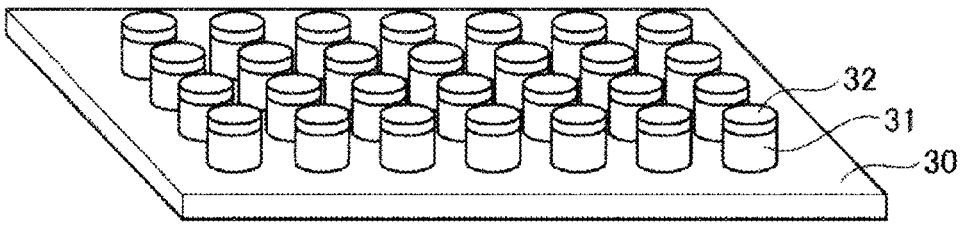
Prior Art FIG.11
FIG. 11 is a perspective model diagram of the polishing sheet shown in FIG. 10.

In the example, the sheet 10 as described above with reference to FIG. 2 is employed as the sheet including a plurality of convex portions and being used as a base material. The sheet 10 is sequentially supplied to a nozzle 6, as shown in FIG. 7, so that the surface on which the convex portions are formed (foreground surface) faces downward. Herein, a roller 5 contacts the rear side surface of the sheet 10 from above near the contacting area with the nozzle 6. A binder is supplied from the nozzle 6 which contacts the sheet 10 near the lowest point of the sheet 10 which is formed through the contact with the roller 5 so as to form a binder layer 2 on the upper surface 10*a*1 and the side surface around the upper surface 10*a*1 of the convex portion 10*a* of the sheet 10. That is, the binder layer 2 is formed only on the upper surface 10*a*1 of the convex portion 10*a* and the side surface 10*a*2 around the upper surface 10*a*1 as shown in FIG. 8. Upon supplying the abrasive grain 1 on the binder layer 2, the binder layer 2 holds the abrasive grain 1. Thus, efficient arrangement of the abrasive grain 1 is achieved. Through the configuration shown in FIG. 8, equivalent polishing efficiency to those in the above two examples can be obtained. Simultaneously, the necessary amount of the abrasive grains can be reduced.

Although preferable examples of the present invention have been described above, however, the polishing sheet and the polishing tool according to the present invention are not necessarily limited to the above configuration.

It should be appreciated that variations of the polishing sheet and the polishing tool in the present invention may be made in the examples described by persons skilled in the art without departing from the scope of the present invention. Of course, such variations of the polishing sheet and the polishing tool are within the scope of the present invention as long as the configuration of the variation has the configuration of the polishing tool of the present invention.

Embodiment

Hereinafter, Embodiment of the present invention will be described.

<Manufacture of Abrasive Grain>

Polyvinyl alcohol-water mixture was added to powder of ultrafine zirconium oxide ($ZrO_2$) having a particle diameter of 50 nm to 60 nm so as to obtain a slurry. The slurry was sprayed by a spray dryer, thereby a secondary particle a having the number average particle diameter of 60 μm and the maximum particle diameter of 80 μm was obtained. The particle diameter was measured by dry measurement using a laser diffraction/scattering particle granularity distribution measuring apparatus LA-920 manufactured by HORIBA, Ltd.

The secondary particle was processed through heat treatment in an electric furnace. By the heat treatment, polyvinyl alcohol which had been used as the binder upon forming the secondary particle was removed completely.

Herein, according to a pre-researched condition, a temperature and time for the heat treatment were controlled so that the primary particle inside the porous body which functions as the cutting-blade particle when it is used as the abrasive grain has a diameter of 5 μm or less. Thus the abrasive grain was obtained.

After the heat treatment, the sectional surface of the obtained abrasive grain was observed by a scanning electron microscope. The result indicated that the abrasive grain is a granular porous body which is composed by partially-bonded primary particles having a neck of hyperboloid of one sheet which is formed on the bonding point of each primary particle and having a void in between, as shown in FIG. 1 as a model.

[Manufacture of a Sheet on which a Plurality of Convex Portions is Formed]

A sheet on which a plurality of convex portions is formed was manufactured by the method shown in FIG. 2.

A plurality of (many) rectangular convex portions of 3 mm dice was formed regularly on a polyethylene terephthalate sheet having a thickness of 200 μm. The convex portions were arranged in a grid pattern so that the total area of upper surfaces of the convex portions has 50% of the total area of the sheet as a whole. Herein, the convex portion was configured so that the upper surface thereof has a height of 100 μm from the sheet surface. After observing the sectional surface of the sheet all of the sectional surfaces of the convex portion (sectional surface of the longitudinal direction of the sheet and two sectional surfaces in the sheet width direction) were trapezoid. In addition, it was confirmed that the two angles formed by the upper base of the trapezoid on the upper surface side and two sides of the trapezoid were both an obtuse angle (about 110 degrees).

[Formation of Binder Layer]

A binder layer was formed on the surface of the above-described sheet on which the convex portions are formed. In detail, by dissolving urethane resin as a binder material into solvent (methyl ethyl ketone, toluene) to be 25 mass %, the binder solution was prepared.

[Manufacture of Polishing Sheet of Present Invention (Embodiment)]

The mixture solution was applied onto the above-described sheet surface on which a plurality of convex portions was formed with use of a wire bar coater (PI-1210, product of TESTER SANGYO CO, LTD.) so as to have a weight per area of 25 g/m$^2$ and form the binder layer. Herein, the final thickness of the binder layer was 20 μm on average.

Then, the abrasive grain was supplied onto the binder layer formed above so as to have a weight per area of 50 g/m$^2$. After a one-hour drying process at about 60 degrees C., the polishing sheet having a sectional surface as shown in FIG. 3 as a model was thereby manufactured.

[Manufacture of Polishing Sheet of Comparative Example]

With use of a similar sheet to that used in the above Embodiment, a plurality of rectangular binder layer of 3 mm dice was formed to be in a grid pattern so that the total area thereof continues 50% of the total area of the sheet as a whole through a masking process with use of adhesive tape on one surface.

[Experiment for Washing Water Stains (Experiment to Polish Mirror)]

The removal of water stains adhered on a mirror in a public bathhouse was experimentally performed by hand with use of the above-described polishing sheet or the polishing sheet of the comparative example while adding water (the water stains were partially in an imbricate condition). The result indicated that it was possible to remove water stains with a smaller force with the polishing sheet in the present invention compared with the case in which the polishing sheet of the comparative example was used. The operating time became shorter to be about a half of those in the case in which the polishing sheet of the comparative example was used. Herein, as a result of visual inspection, it was confirmed that the scratches and so on were not generated on the surface of the mirror when the polishing sheet of the present invention was used; however, scratches and so on were generated when the polishing sheet of the comparative example was used.

As described above, the polishing sheet according to Embodiment of the present invention includes a plurality of convex portions in which an upper surface is in parallel to the sheet surface and a sectional surface is a trapezoidal shape. Both two angles formed by the upper base and the sides of the trapezoid are always an obtuse angle. Thereby, it is confirmed that the removal of water stains is significantly effective under the condition in which the abrasive grain is provided on the upper surface and the side surfaces around the upper surface of the convex portion.

In addition, the difference of the height between the abrasive grain on the upper surface and the sheet surface (a groove-like portion between each convex portion) can be increased in the polishing sheet of Embodiment. Thereby, even if such as calcium carbonate or silicon as a main component of the removed water stains or the dropped abrasive grain reaches the groove-like portion, the water stains can be removed easily. According to the above condition, scratching generated while polishing can be avoided.

According to the polishing sheet of the present invention, by a configuration in which a plurality of abrasive grains is arranged on an upper surface of a convex portion protruding from a sheet surface and the upper surface is in parallel with the sheet surface, water stains adhered on a mirror or glass, especially water stains in an imbricate structure which has been extremely difficult to remove by the conventional polishing sheet or polishing tool can be removed easily. Therefore, polishing can be accomplished with a small force at the same time as reducing a risk of scratching the mirror or the glass.

What is claimed is:

1. A polishing sheet comprising:

a sheet surface including a plurality of convex portions protruding therefrom and including an upper surface which is in parallel to the sheet surface; and a plurality of abrasive grains, each abrasive grain having a granular porous body in which plural primary particles are partially bonded to each other and include a void therebetween, wherein the abrasive grains, each constituted by the primary particles partially bonded to each other, are arranged on the upper surface and side surface of the convex portion around the upper surface side of the convex portion of the sheet surface.

2. The polishing sheet according to claim 1, wherein a sectional surface of the convex portion protruding from the sheet surface has a trapezoid shape, and both of two angles which are formed by an upper base of the trapezoid on the upper surface of the convex portion and two sides of the trapezoid have an obtuse angle.

3. The polishing sheet according to claim 1, wherein the abrasive grain is arranged on the sheet through a binder.

4. A polishing tool including the polishing sheet according to claim 1.

* * * * *